US008769891B2

(12) United States Patent
Kelly

(10) Patent No.: US 8,769,891 B2
(45) Date of Patent: Jul. 8, 2014

(54) BUILDING METHOD USING MULTI-STOREY PANELS

(76) Inventor: Ian Kelly, Calgary (CA)

( * ) Notice: Subject to any disclaimer, the term of this patent is extended or adjusted under 35 U.S.C. 154(b) by 0 days.

(21) Appl. No.: 14/003,553

(22) PCT Filed: Apr. 4, 2012

(86) PCT No.: PCT/CA2012/050215

§ 371 (c)(1),
(2), (4) Date: Sep. 6, 2013

(87) PCT Pub. No.: WO2012/135954

PCT Pub. Date: Oct. 11, 2012

(65) Prior Publication Data

US 2014/0013684 A1 Jan. 16, 2014

Related U.S. Application Data

(60) Provisional application No. 61/471,767, filed on Apr. 5, 2011.

(51) Int. Cl.

| | |
|---|---|
| ***E04H 1/00*** | (2006.01) |
| ***E04H 14/00*** | (2006.01) |
| ***E04H 3/00*** | (2006.01) |
| ***E04H 5/00*** | (2006.01) |
| ***E04H 6/00*** | (2006.01) |

(52) U.S. Cl.

USPC ..... 52/235; 52/234; 52/236.3; 52/236.6; 52/236.7; 52/243

(58) Field of Classification Search

USPC ..... 52/234, 235, 236.3, 236.6, 236.7, 243

See application file for complete search history.

(56) References Cited

U.S. PATENT DOCUMENTS

| | | | | |
|---|---|---|---|---|
| 3,107,755 | A * | 10/1963 | Thibert | 52/94 |
| 5,524,400 | A * | 6/1996 | Schmechel | 52/474 |
| 7,712,270 | B2 * | 5/2010 | Guevremont | 52/235 |
| 8,186,128 | B2 * | 5/2012 | Way | 52/742.14 |
| 2010/0058700 | A1 * | 3/2010 | LeBlang | 52/506.05 |
| 2011/0225905 | A1 * | 9/2011 | Kusuma | 52/174 |

* cited by examiner

*Primary Examiner* — Mark Wendell

(74) *Attorney, Agent, or Firm* — Sean W Goodwin; Linda M Thompson

(57) ABSTRACT

A method is provided for erecting a multi-story building on a foundation using a plurality of pre-manufactured multi-story wall panels. A plurality of wall panels are erected on the foundation to form a perimeter of wall panels which extend vertically to span two or more stories of the building. A plurality of floor joists are joined between multi-story wall panels to extend generally horizontally therebetween. Optionally, once erected, concrete can be placed between the studs of the wall panels and in channels between joists. Various methods and materials for finishing the exterior side of the wall panels and reinforcing the wall panels and the joists are also provided.

33 Claims, 12 Drawing Sheets

BUILDING METHOD USING MULTI-STOREY PANELS

FIELD

Embodiments herein relate to pre-manufactured wall panels and methods for erecting a building using said wall panels in a perimeter and joining floors therebetween.

BACKGROUND

Various attempts have been made to reduce construction costs for buildings using modular components. Although various forms of modular panels are known, known modular panels still employ relatively conventional building methodologies. Namely a building is erected one floor or story at a time by forming a first perimeter wall with the modular panels, supporting a floor thereon and then forming a next story of modular panels on the floor. This manner of construction is relatively inefficient.

U.S. Pat. No. 4,514,950 to Goodson Jr. and U.S. Pat. No. 7,665,251 to Lang et al disclose examples of multi-story construction using steel studs erected onsite and which span multiple stories, however, the erection method still requires complex placement of many individual components which is time consuming and inefficient.

U.S. Pat. No. 5,048,257 to Luedtke and U.S. Pat. No. 7,562,500 to Siu disclose examples of concrete incorporated into steel framed structures for increasing the strength thereof, however such systems also require placement of many individual components in stories so as to be somewhat inefficient.

SUMMARY

Generally, a method is provided for erecting a multi-story building on a foundation. A plurality of perimeter wall panels can be prepared using spaced-apart vertical studs and exterior sheathing material spanning an outer side of the studs. The wall panels are erected about a perimeter on the foundation such that at least some of the perimeter wall panels comprise multi-story panels which span two or more stories of the building. Opposing multi-story panels are joined together using a plurality of floor joists joined at an intermediate location between opposing top and bottom ends thereof. On another aspect the spaces between the studs of at least the lower portion of said multi-story panels, such as those below grade, or the entirely of the height of wall panel, can be filled with concrete. In another aspect hollow channels, formed between the joists, are also filled with concrete while forming an upper floor surface of concrete spanning over the joists. Concrete and appropriate reinforcing members can extend continuously between the floor and the wall panels.

By forming multi-story panels including studs which span multi-stories within the panels, several stories of a building can be erected quickly and efficiently with a single row of panels about the perimeter of the foundation. Floor joists can then be joined to the studs spanning the multiple stories of the panels at an intermediate location thereon with the loads from each floor thereabove being transferred directly through the studs instead of being stacked on the floors between the stories of the building as in conventional construction.

When a portion of the wall panels extends below grade, that portion can be filled with concrete for added strength and the balance can be fit with conventional insulation including fiberglass batting. Likewise, the entire multi-story panel can be filled with concrete to allow greater strength for building more stories, again with the simple construction of multi-story panels which can be quickly erected.

A floor system is also readily adaptable to the perimeter wall panels in which floor panels are formed with sheathing on the bottom side so that at least an upper recess of the hollow channels between the joists can be filled with concrete together with an upper floor surface spanning over top of the joists to strengthen the joists and the floor structure as a whole, which permits a much longer span than conventional construction techniques.

Accordingly, in one broad aspect a multi-story wall panel is provided for arranging about a perimeter with a plurality of additional multi-story wall panels for erecting a multi-story building. Each wall panel comprises a plurality of spaced apart studs extending vertically to span two or more stories of the building. Exterior sheathing material spanning at least an exterior side of the studs and at least one floor location at an intermediate location between top and bottom ends thereof for receiving floor joists of at least one floor of the multi-story building.

Further, a system and a method is provided for erecting a multi-story building on a foundation comprising forming a plurality of the multi-story wall panels. The wall panels are erected on the foundation to form a perimeter of wall panels, at least some of the perimeter wall panels being multi-story wall panels extending vertically to span two or more stories of the building. A plurality of floor joists are joined to the multi-story wall panels to extend generally horizontally therefrom, the floor joists being joined to the multi-story wall panels at an intermediate location between top and bottom ends thereof. Concrete can be applied between the studs, either at lower portion below grade, or along the height of the wall panels. Concrete can be applied between and over the floor joints to form concrete flooring. Concrete applications can include spacer or furring on the exterior, the interior or both sides of the studs to enable concrete encasing of the studs. The exterior sheathing material can be supplemented with base layers of finishing and further supplemented with a finishing layer.

DETAILED DESCRIPTION

With reference to the accompanying figures, a building system and method is provided for erecting a multi-story building 10 using multi-story wall panels 12 supported on a suitable foundation 14. The foundation 14 can be conventional including footings. The foundation 14 can be located either at or below grade, or combination thereof.

Figure 1:
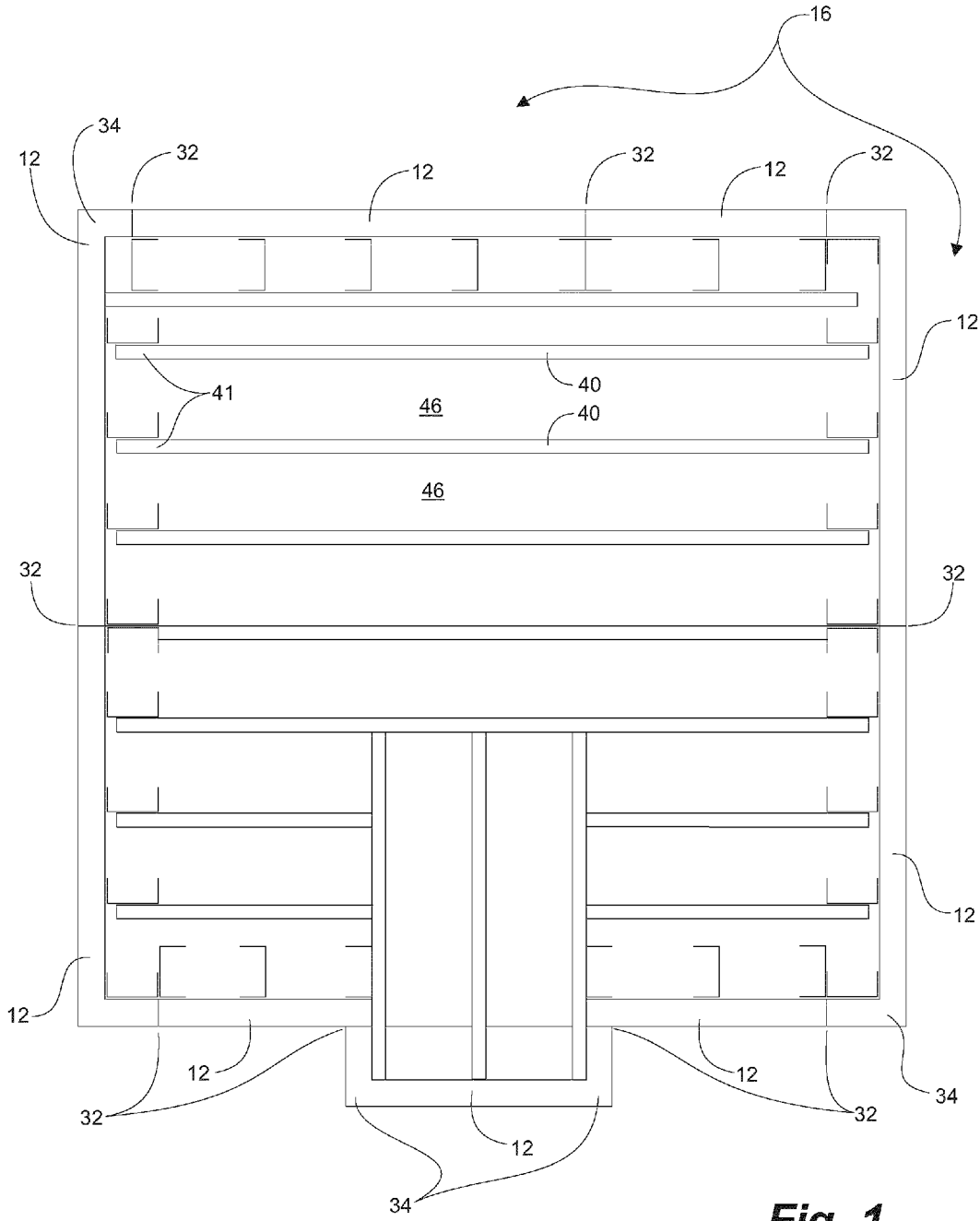
FIG. 1 is a plan view of the perimeter walls and joists of one floor level of a building construction.
Figure 2A:
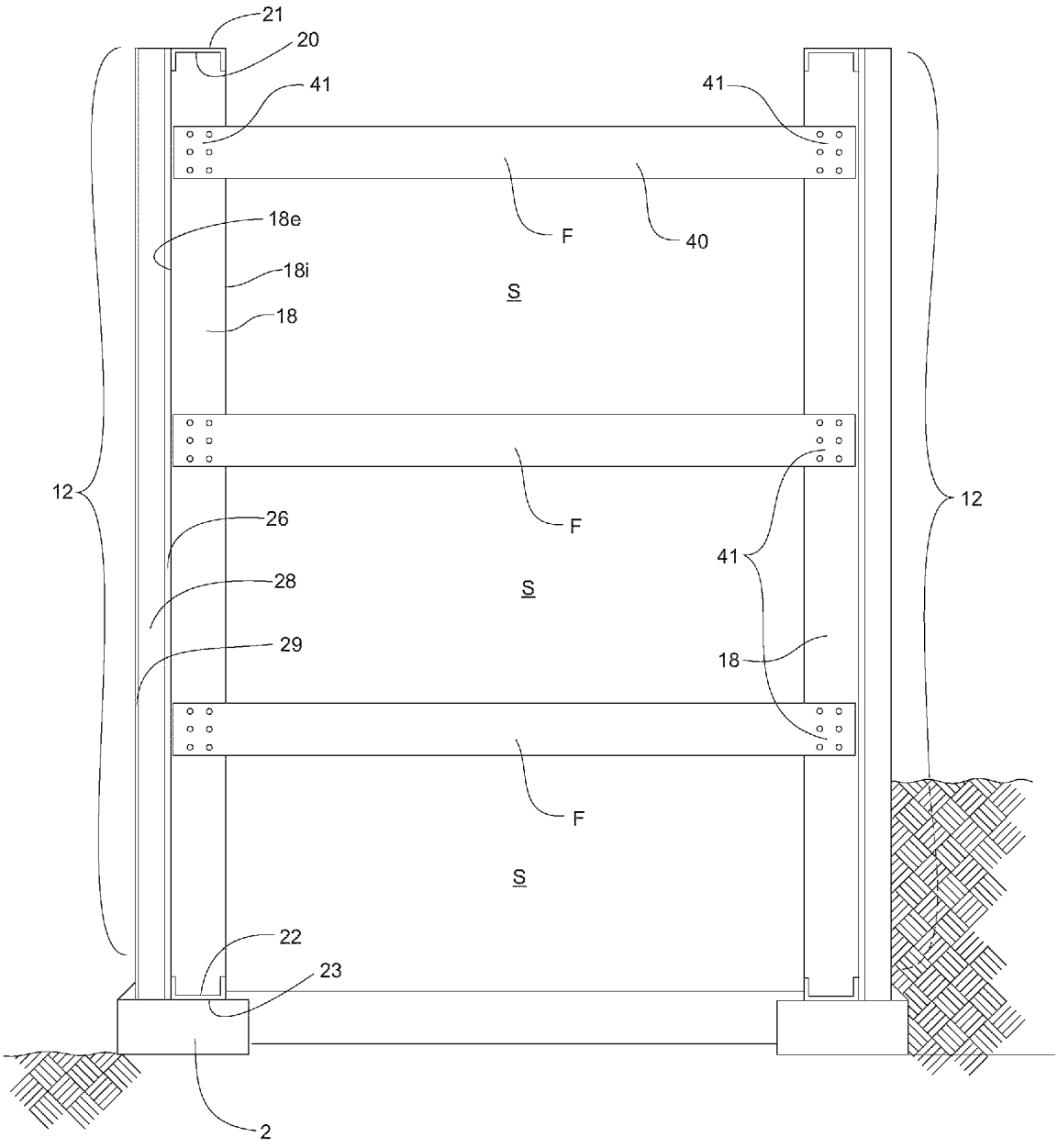
FIG. 2A is a cross sectional view along a vertical plane along the line 2-2 of FIG. 1, one perimeter wall being shown below grade and the opposing perimeter wall being shown above grade for illustrative purposes only.

With reference to FIGS. 1 and 2A a plurality of modular wall panels 12 which are preassembled at a manufacturing location prior to being erected on the foundation 14. The panels 12 are shipped to the building site. The panels 12 are assembled to form enclosing and intermediate walls on the foundation 14. The wall panels 12 are generally used for forming exterior perimeter walls but can also usefully form interior load-bearing walls, also forming perimeter walls for interior spaces. Other panels may include intermediate wall panels or preassembled floor panels as well as various roof panels and the like as may be desired. The load bearing wall panels are also pre-manufactured and are structurally similar to the perimeter wall panels with the exception of the choice of exterior finishing materials.

A plurality of wall panels 12 are erected in a vertical orientation about an exterior perimeter 16 on the foundation 14. In an embodiment, each of the modular panels is a multi-story panel 12 which, when placed on the foundation 14, extends vertically two or more stories S in elevation, separated by one or more floors F. Thus, in an embodiment, a plurality of vertically-extending modular wall panels 12, 12, . . . are arranged side-by-side about the perimeter 16 in a generally horizontal direction and extend about the height of the building 10. A horizontal dimension or width of the wall panels is typically dictated by local transport dimensional restrictions. For transport on most highways in North America, the maximum transport width, without the need for special permits or pilot vehicles, is generally 2.6 m or 8'-6". Other widths can be shipped as required. The wall panels 12 may also be assembled onsite if the width of the wall panels 12 exceeds the maximum transport width. After assembly the assembled panels 12 are erected.

The wall panels 12 are thus manufactured to span at least two stories S, at least one intermediate floor F forming a ceiling for a first story and a supporting floor for a second story S. The wall panels 12 typically span the full height of the building 10 including levels below grade.

In embodiments, each wall panel 12 is formed of a plurality of vertical studs 18, spaced laterally, and which span the full height of the panels 12 such that each stud 18 spans multi-stories with the exception of studs having cut-outs for window and door openings. Additional framing is provided about window and door openings in the conventional manner (not shown). Where no windows or door openings are present, the studs 18 span the full height between a header 20 spanning a top end 21 of the wall panel 12 and a footer 22 spanning a bottom end 23 of the panel 12. The studs 18 can therefore accommodate attachment and support of at least one floor F at an intermediate location between top and bottom ends 21,23 thereof. Each floor F comprises a plurality of floor joists 24, the studs 18 receiving the floor joists 24 of at least one floor F of the multi-story building 10.

In one embodiment, each of the studs 18, the header 20 and the footer 22 of each wall panel 12 comprise a metal channel typically C-shaped in cross-section having two side flanges and a main flange connected therebetween.

In one embodiment, the studs 18 and the floor joists 24 may be made of wood.

The studs 18 are joined together to form preassembled wall panels 12 using a layer of an exterior sheet or sheathing material 26 which fully spans an exterior side 18*e* of the studs 18 for forming an exterior side of the wall panel 12. The exterior sheathing material 26 may be various wood materials such as oriented strand board (OSB) or plywood, as well as any other suitable construction board such as cement board and the like. The exterior sheathing material 26 may be joined directly to the studs 18.

Prior to erecting the wall panels on the foundation, the wall panels can be finished on the exterior side by various means. In the illustrated embodiment, the exterior side is finished using at least a base layer of finishing material known in the art as an Exterior Insulation Finishing System (EIFS). The finishing material may further include an exterior finish such as an acrylic stucco finish. The finishing is resistant to damage during handling between manufacture, transport and erection on site.

Alternate or additional finishing includes using siding over the exterior sheathing material or using a base layer of EIFS having a stone or brick veneer exterior finish.

Figure 2B:
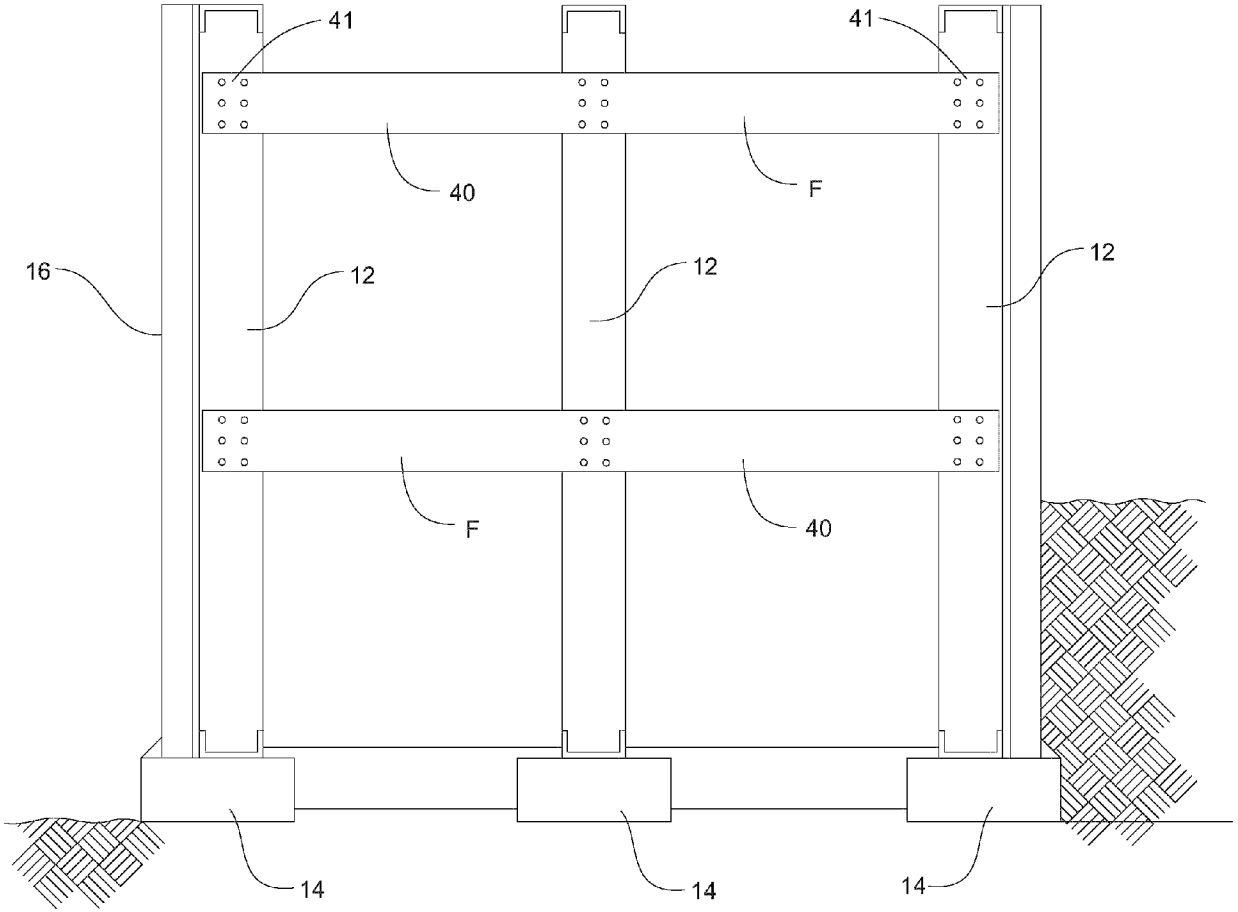
FIG. 2B is a cross-sectional view along the line 2-2 of FIG. 1 having a load bearing interior wall added between perimeter walls wherein the floor joists are continuous therebetween.
Figure 2C:
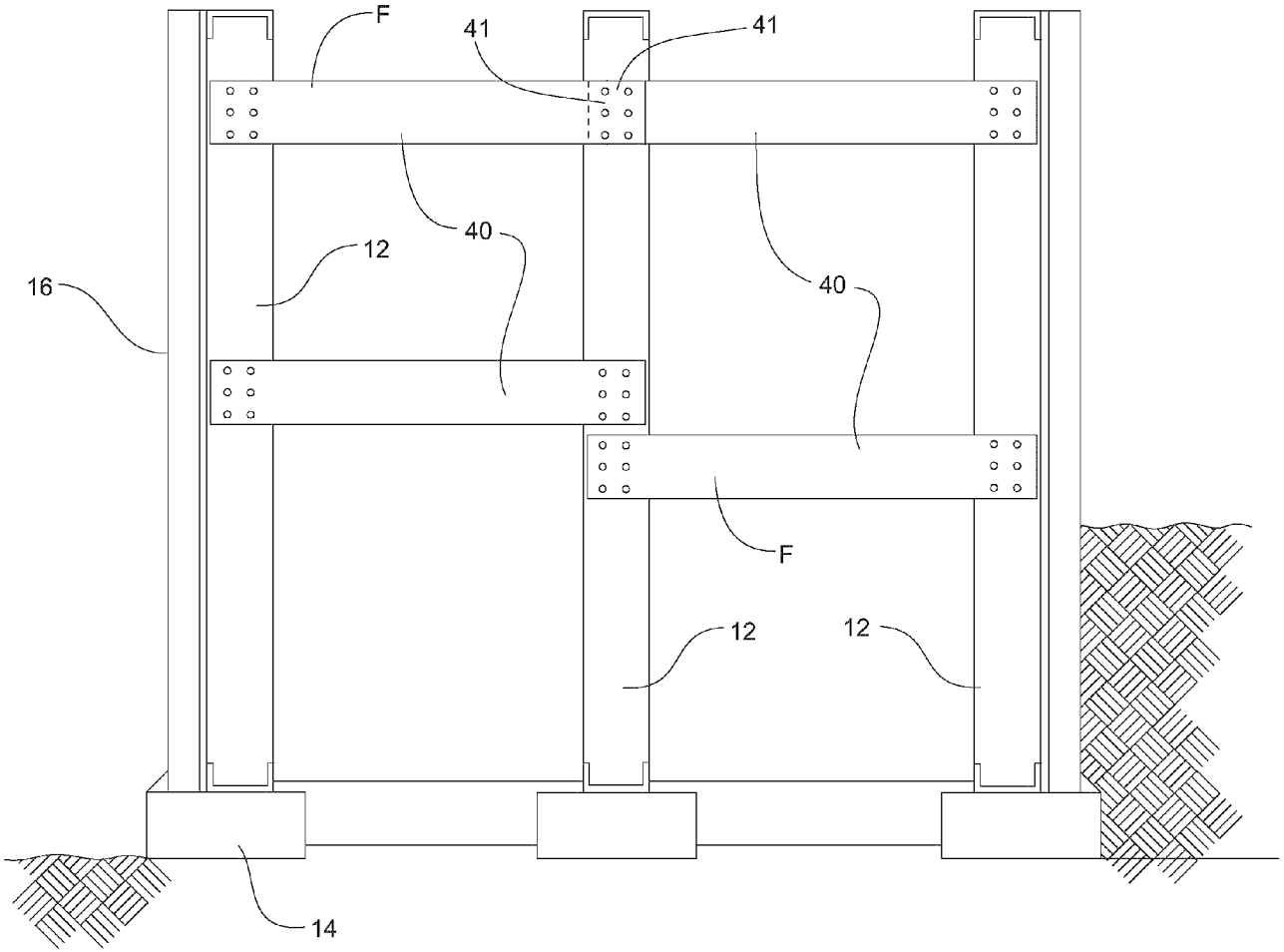
FIG. 2C is a cross-sectional view along the line 2-2 of FIG. 1 having a load bearing interior wall added between perimeter walls wherein the floor joists are discontinuous therebetween.
Figure 2D:
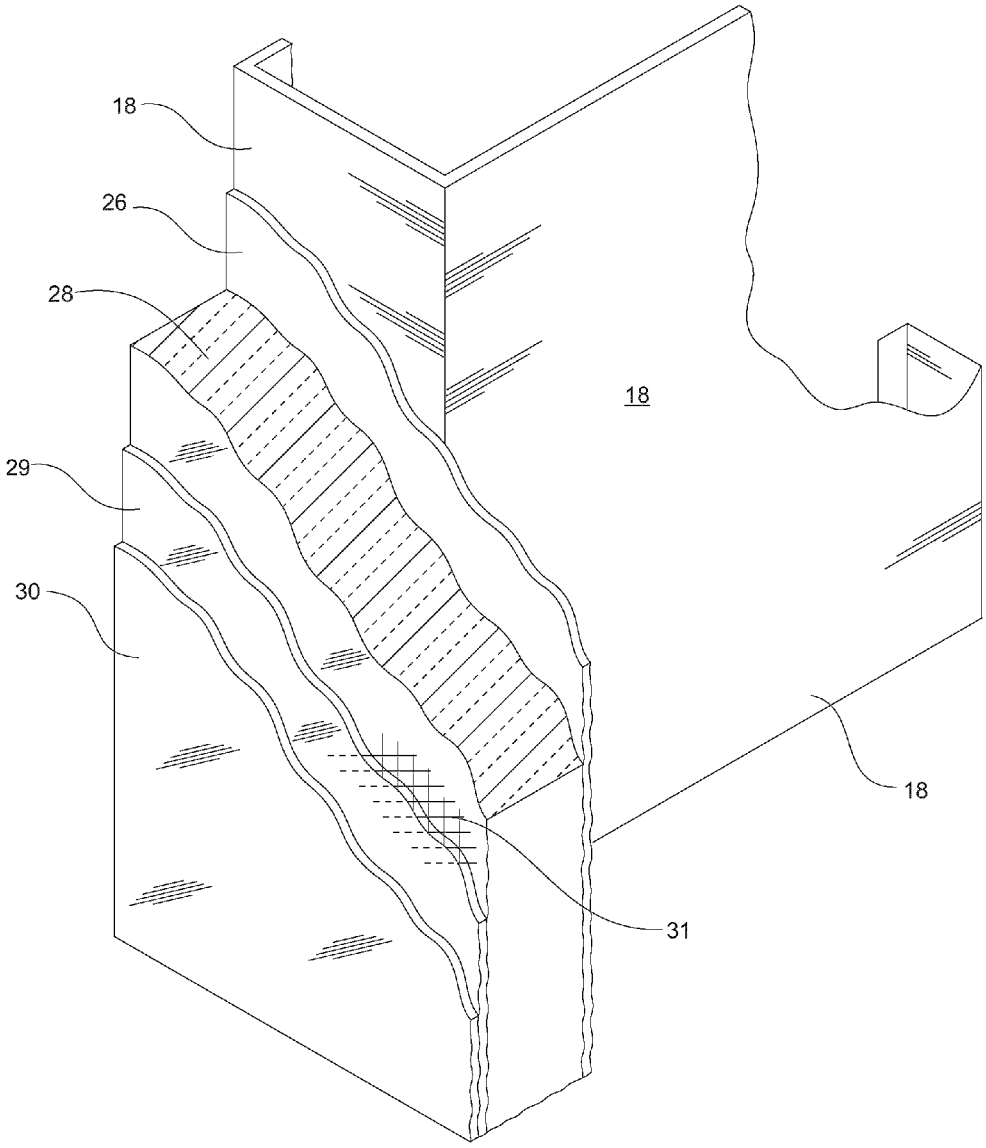
FIG. 2D is a partial cross-sectional perspective view of the exterior sheathing material and finishing materials.

Best shown in FIG. 2D, a layer of sheets of exterior rigid insulation 28, for example in the order of 2 to 3 inches in thickness, is applied over the exterior sheathing material 26. Typically a roll-on coating is provided over the sheathing material 26 before the exterior rigid insulation 28 is applied. The roll-on coating acts as a moisture barrier. The exterior rigid insulation 28 can be laminated to the exterior side of the layer of exterior sheathing material 22. Also the space between the studs 18 can be fit with conventional insulation including fiberglass batting.

A base layer 29 of finishing materials such as a base layer of the EIFS can then be applied to the exterior of the rigid insulation in a conventional manner using a supportive mesh material or other suitable method to minimize steps required to complete construction subsequent to erecting the wall panels. A final finishing layer 30 is then applied to the base layer 29 such as a finished stucco layer which forms the finished exterior appearance of the completed building. The finishing layer 30 can be applied prior to, or after, erecting the wall panels 12.

Figure 8:
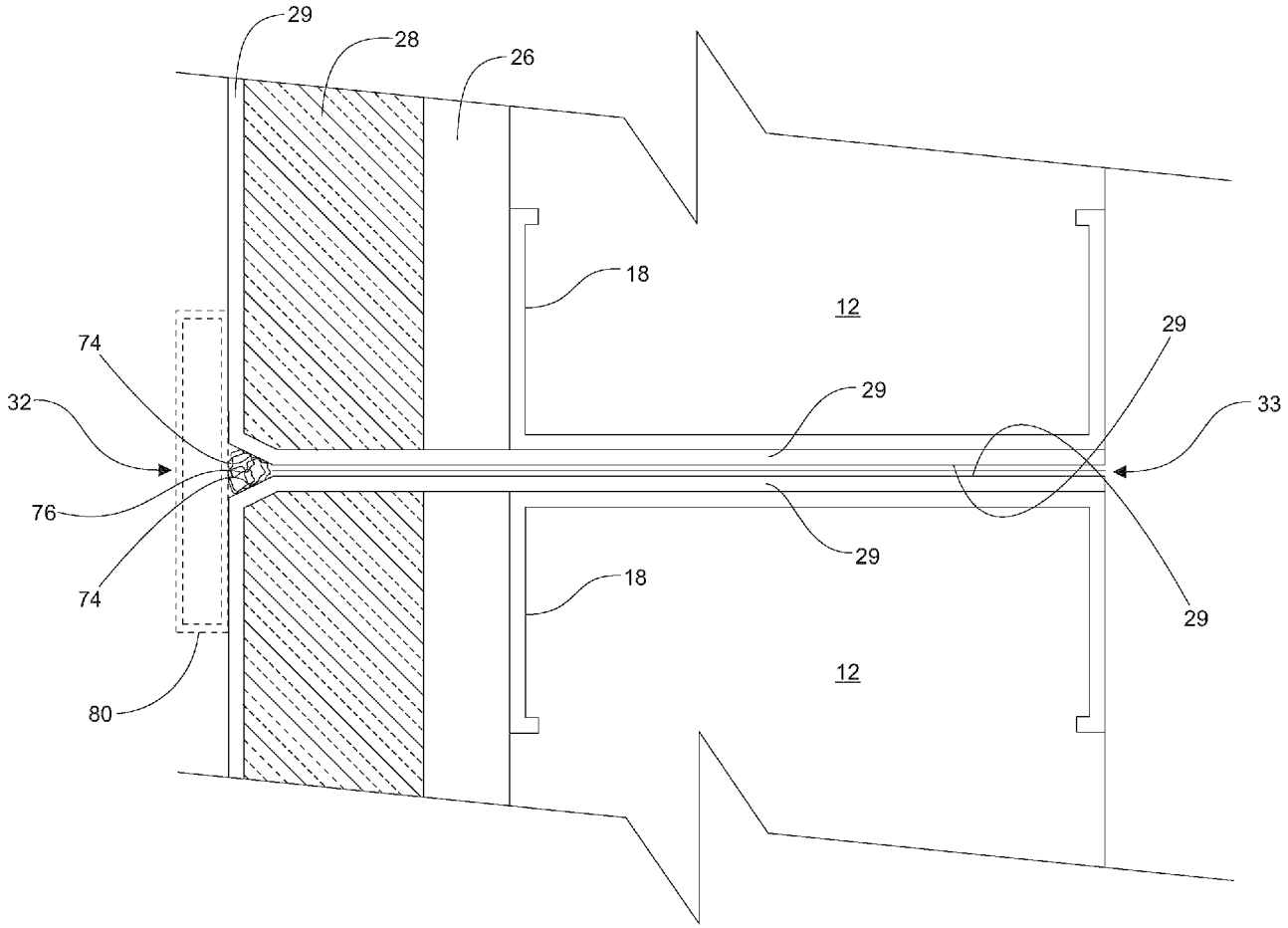
FIG. 8 is a sectional view along the line VIII-VIII of FIG. 4 at a vertical seam between two abutted perimeter wall panels.

As shown in FIG. 1, vertical seams 32 are formed between adjacent panels 12,12. When only the base layer 29 is applied prior to erecting the wall panels, the vertical seams 32 can then be filled or otherwise joined with tape or caulking or the like prior to application of the finished coat so that the finished coat is a weatherproof layer. Alternatively, as shown in FIG. 8, when a finished layer 30 is already provided, finishing trim or appropriate filler material such as caulking and the like can be then placed along the vertical seams 32 to complete the finished appearance of the exterior of the building 10.

Pre-manufacturing, which can further include the base layer 29 or finishing layer 30 results in a superior finish, reduced time and expense. Further, such pre-manufacture minimizes or eliminates the need for scaffolding on site during erection of the wall panels 12. Further the perimeter walls of the multi-story building are quickly assembled to enclose the building interior. Further, wall panels for a particular multi-story building can be varied in dimensions and exterior finishing, being adapted or designed for the particular building's structural aspects and aesthetics. As shown in FIG. 1, the wall panels can be of varying widths and incorporate one or more corner pieces 34. Adjacent wall panels 12 can be secured to one another using fasteners such as screws or bolts.

After erecting the wall panels 12, opposing panels 12,12 are joined with one another with one or more floors F of the multi-story building 10. The floors F are formed and supported from the wall panels 12,12 using a plurality of floor joists 40,40 . . . or the floors F may comprise preassembled floor panels comprising the floor joists 40. The joists 40 are joined to the studs 18 at joist end portions 41 using fasteners, such as screw or bolts.

In FIG. 2A, joists 40 extend from at least one exterior wall panel 12 to an opposing wall panel 12. With reference to FIG. 2B the joists 40 extend from at least one perimeter wall panel to an interior load bearing wall panel. The interior load bearing wall may be a single story or a multi-story panel 12. The floor joists are continuous and extend through the load bearing internal wall for connection at end portions 41 to a second and opposing perimeter wall panel 12. As shown in FIG. 2C, the joists 40 can be discontinuous, extending from a first perimeter wall panel 14, to the interior load bearing wall and additional joists 40 extending from the interior load bearing wall for connection at end portions 15 to the second opposing perimeter wall panel 12. Larger multi-story structures would have a combination of multiple internal load bearing internal wall panels, multiple discontinuous sets of joists 40 between combinations of multi-story internal wall panels 12 and perimeter wall panels 12. Note that internal wall panels 12 also form perimeters about internal spaces, either with exterior wall panels or with opposing internal wall panels.

Figure 3:
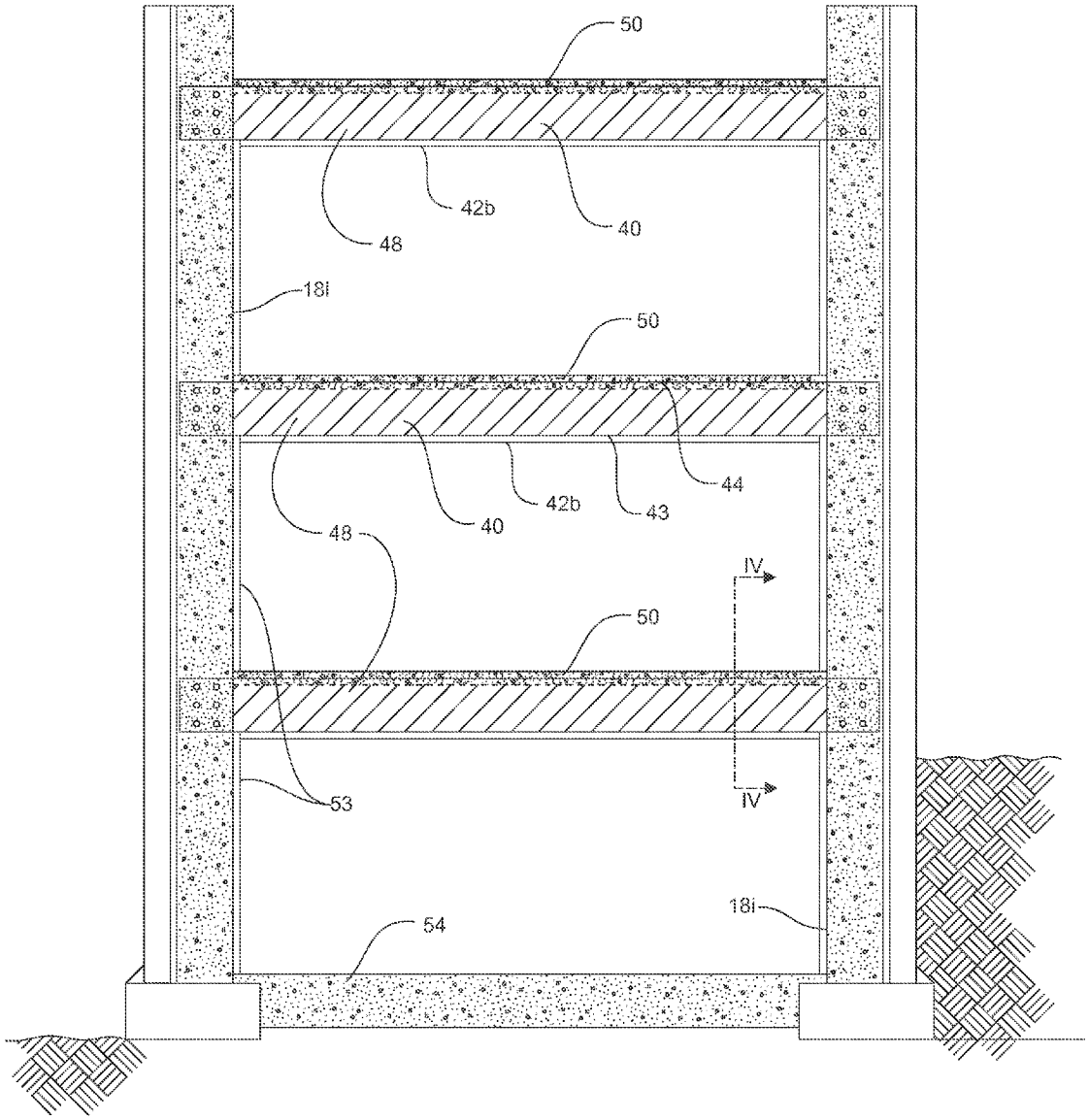
FIG. 3 is a sectional view similar to FIG. 2A, subsequent to the additional steps of applying sheathing and filling the floor and wall panels with concrete.
Figure 4:
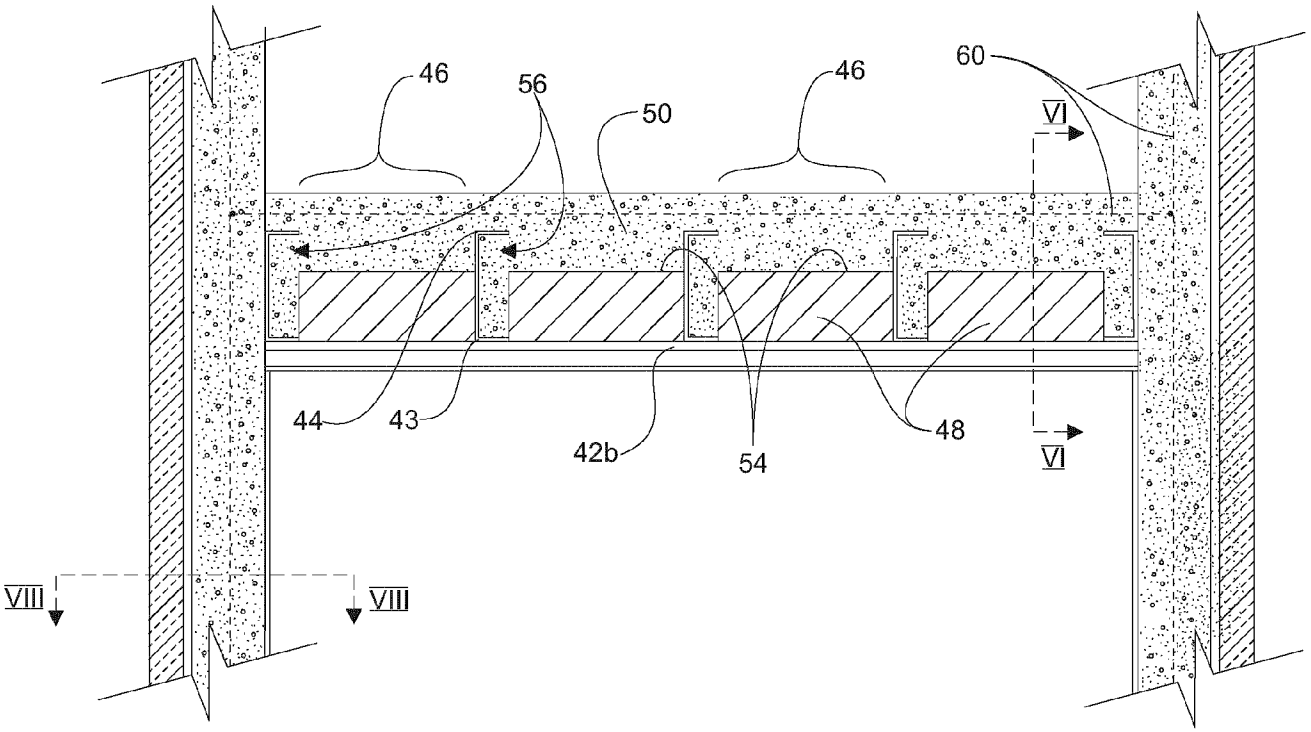
FIG. 4 is a sectional view along the line IV-IV of FIG. 3.

With reference also to FIGS. 3 and 4, the floor joists 40 can be connected together by a sheathing layer of flooring sheet material 42. Joists 40 have an underside 43 and a top side 44. In the case of concrete-construction flooring, a bottom flooring sheet material 42*b* can span an underside 43 of the joists 40 forming channels 46 between joists 40,40 for receiving filler 48 as a base when forming an upper concrete floor surface 50 as described further below. Alternatively, the layer of flooring sheet material may span top sides of the joists in conventional manner for wood floor construction. A layer of upper flooring sheet material would typically comprise a wooden subfloor material such as OSB or plywood for example.

Figure 5:
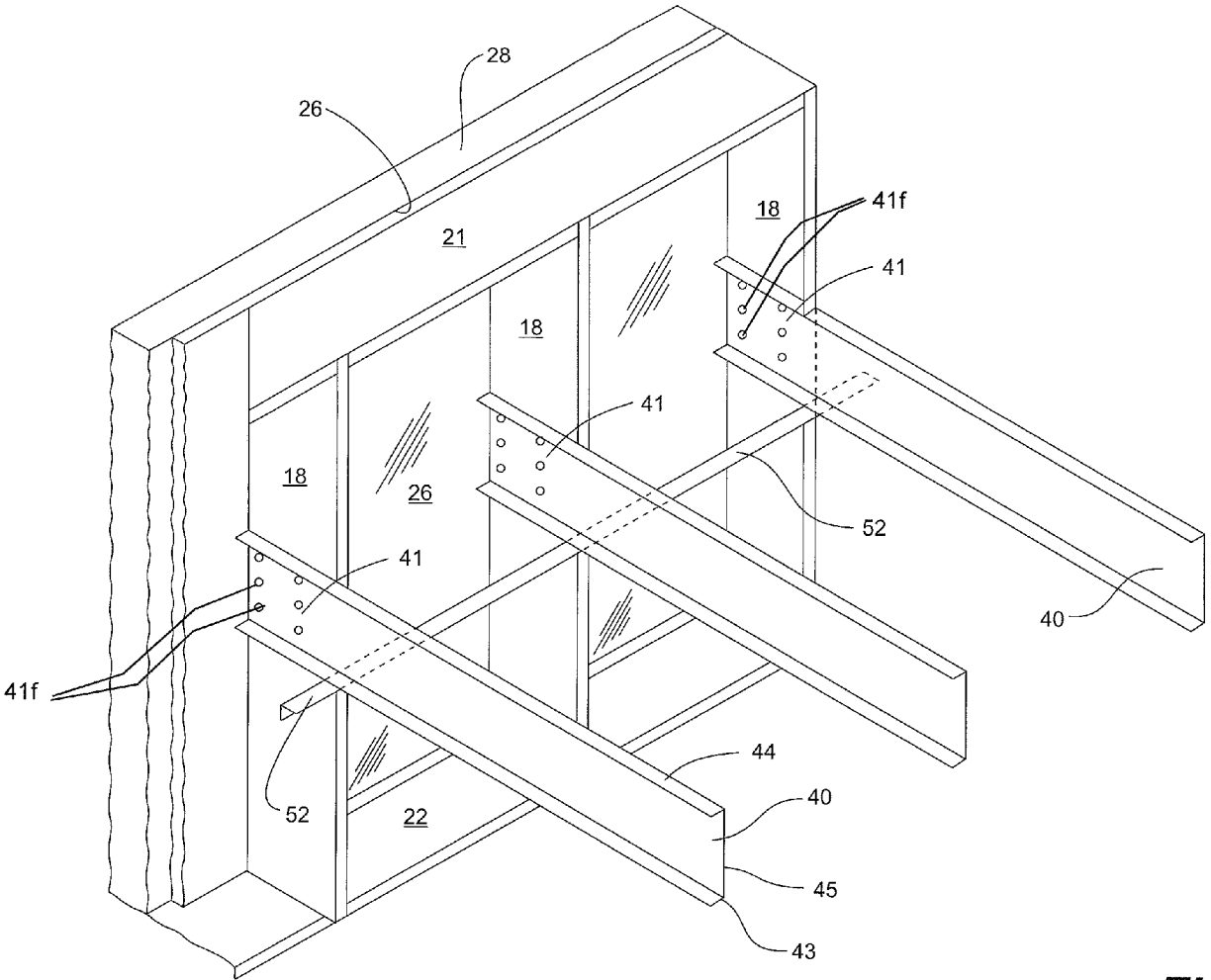
FIG. 5 is a perspective view of the floor joists connection to the studs of the multi-story panels.

With reference to FIG. 5, the floors can be put in place by initially placing individual floor joists 4, prior to application of sheathing 26 and subsequent completion of the floors, or installed as preassembled floor panels. In each instance, the joists 40 are supported at opposing ends 41,41 on respective studs which are aligned with one another on the opposed wall panels 12,12. Primarily for ease of installation, a length of a bracket or ledger 52, such as a length of angle iron, can be positioned transversely across an interior side of the studs 18 for leveling and supporting the floor joists 40.

The floor joists 40 can be manufactured of metal channels which are hollow and may have a C-shaped cross section for example. In this instance, each floor joist top side 44 includes a top flange, and each underside 43 includes a bottom flange and a side web 45 therebetween so as to be open along the opposing side thereof. Opposing ends 41,41 of the joists 40 are joined directly to the studs 18 at an intermediate location along the length thereof by laying the side web of the channel flat against the base flange of the corresponding stud and joining the two flanges with suitable fasteners. Alternatively, the flanges of the vertical studs 18 can be notched out to receive a joist therein. Standard wooden beams as joists 40 can implement the ledger 52, hangers or other standard means for connection to the vertical studs. If the floors comprise pre-assembled panels, end portions 41 of the joists 40 protrude beyond the floor sheathing 42*b* to define a fastening portion at the end portion 41 which overlaps the studs 18 for joining thereto and mounting the floors in place.

Having reference to FIGS. 2A, 2B, 2C, 3, 5 and 6, opposing end portions 41,41 of the floor joists 40 are joined directly to respective studs 18,18 at an intermediate location along the length of opposed wall panels 12,12. Each opposing end or end portion 41 of the floor joists 40 defines a fastening portion which overlaps its respective stud 18, whether an internal wall panel of FIG. 2B or 2C or an exterior wall panel 12 of FIGS. 2A-2C, 3, 5 and 6. As illustrated in FIG. 5 the opposing end portions 41 are fastened to the studs 18 using fasteners 41*f*, such as screws or bolts. The fasteners 41*f* generally extend through the opposing end portion 41 and into the stud 18 for fastening the floor joist 40 thereto.

Returning to FIG. 4, in either instance, the floors F can be finished to have a concrete upper surface 50 by providing a suitable barrier member 48 in the space between each adjacent pair of floor joists. The barrier member 48 is a filler to minimize the concrete usage. The barrier member can be in the form of blocks of rigid insulation or other filler material. The barrier member 48, for example Styrofoam® (Trademark Dow Chemical) sheets or blocks, fully span the width and length of the channel 46 between each adjacent pair of joists 40,40. The barrier members 48 are typically mounted in place such that the bottom side thereof are flush with the underside 43 of the joists and supported by the bottom flooring sheet material 42*b* spanning the bottom side of the floor joists 40.

The depth of the barrier members 48 can be sized such that their upper surface 54 is recessed downwardly and spaced below the top side 44 of the joists 40 so to define the upper space or upper recess 46 therebetween. In the case of C-shaped metal joists, the upper recess 46 is in open communication with an open side 56 of at least one of the adjacent joists 40 as well as being open above the joists 40 prior to pouring concrete 50 therein. For preassembled floor panels, the barrier member 48 may be already installed in the preassembled floor F or may be subsequently installed after the floor joists 40 are already connected to the studs 18.

Once the floor joists 40 are in place, the concrete is then poured over the joists such that the concrete flows into the upper recess 36 of each joist 40 to form a continuous concrete floor surface layer spanning across and overtop of the joists. At least the upper recesses are filled with concrete to encase at least the top of the joists. A typical thickness of concrete surface is 2 inches over the top of the joists. In this embodiment, the upper recesses expose the top of the joists to be at least partially embedded in the concrete. Again, for embodiments using metal joists, having a C-shape, the concrete further encroaches into the interior of the joist.

Appropriate reinforcing material 60 such as rebar, mesh, wire screening or other strengthening members may span overtop of the joists to connect the concrete in each of the spaces between joists as a continuous concrete floor integral with the joists. In this manner, the floor is much stronger than conventional wooden joist construction to accommodate longer spans.

As stated earlier, the wall panels 12 can also be partially or completely filled with concrete 50. In an embodiment, only that lower portion below grade, if any is filled with concrete.

As shown in FIG. 3, to strengthen the wall panels 12, the space between adjacent vertical studs 18,18 may be filled with concrete 50. One can plan in advance to rough-in or otherwise incorporate wiring and the like into such wall panels before pouring concrete. Alternatively, a form of spacing members, such as furring, can be used to provide utility spacing for post-concrete installations.

A layer of interior sheathing 53 of suitable sheet material across the interior side 18*i* of the studs 18 substantially encloses spaces between the studs 18,18 for forming a suitable cavity to receive the concrete. The layer of interior sheathing 53 may be applied prior to erecting the wall panels, however, it is preferred that the wall panels 12 remain open between the studs 18,18 on the interior side 18*i* thereof until subsequent to the walls being erected and the floor joists 40 being joined thereto. In some instances only a lower portion of the wall panel and space between the studs of the wall panel is filled with concrete when the lower portion corresponds to the portion of the panel extending below grade. In this instance, the spaces between the studs are typically filled together with pouring of a basement floor 54.

Alternatively, the entire height of the wall panels 12 can be filled with concrete to strengthen the wall sufficiently such that a greater number stories can be formed in the building. In this instance, the cavities between the studs of each wall panel 12 can be filled with concrete 50 together at the same time as pouring the concrete between and over the floor joists 40 and forming the upper floor surfaces of each floor F.

As shown in FIG. 4, if filling the wall panels with concrete, reinforcing material 60 such as rebar may also be provided in the cavities of the walls panels 12 and tied to the reinforcing material 60 in the concrete 50 of the floors F.

Figure 6:
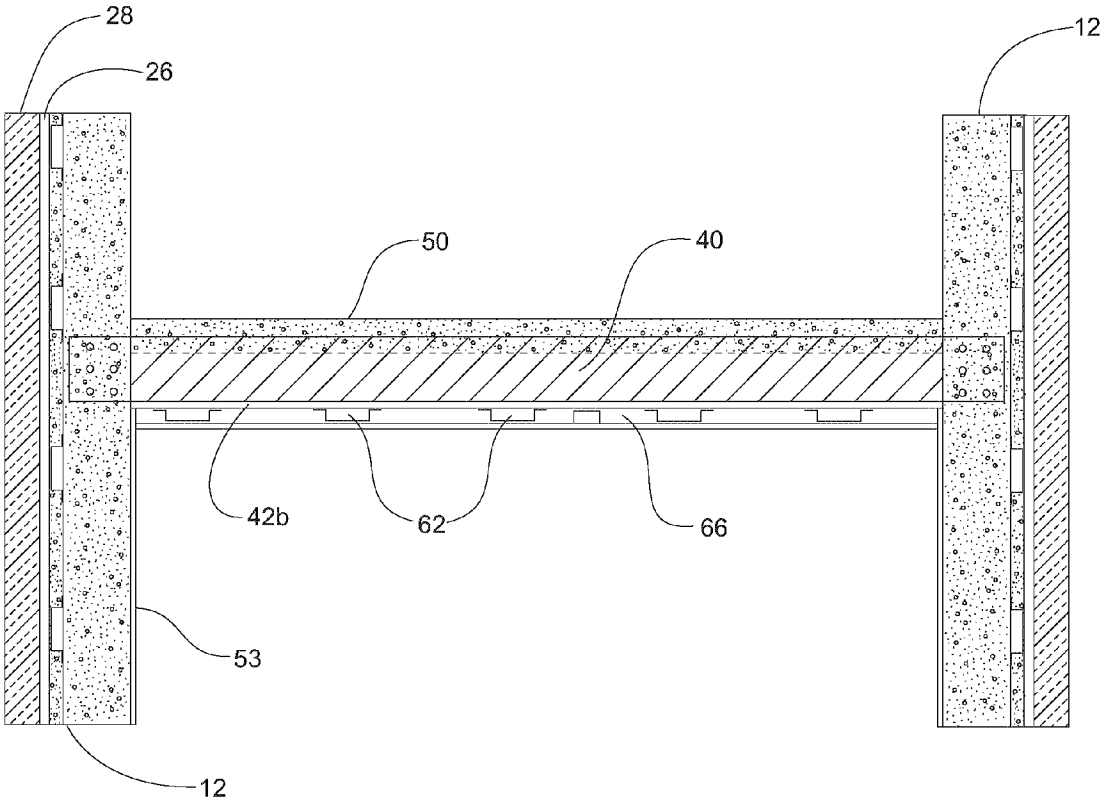
FIG. 6 is a sectional view along the line VI-VI of FIG. 4.

With reference to FIG. 6, the bottom side of each assembled floor section which forms the ceiling of the level therebelow can be finished by providing a plurality of ceiling support members 62 in the form of elongate channels which span the joists 40. The plurality ceiling support members 62 are parallel and spaced apart with one another so as to be perpendicular to the joists and spanning across plural joists. The support members 63 also function as spacer members so that interior finishing panels 64, for example drywall, can be supported on the bottom side of the support members at a prescribed space below the sheathing 42*b* to provide a utility space 66 for receiving electrical and like.

Figure 7:
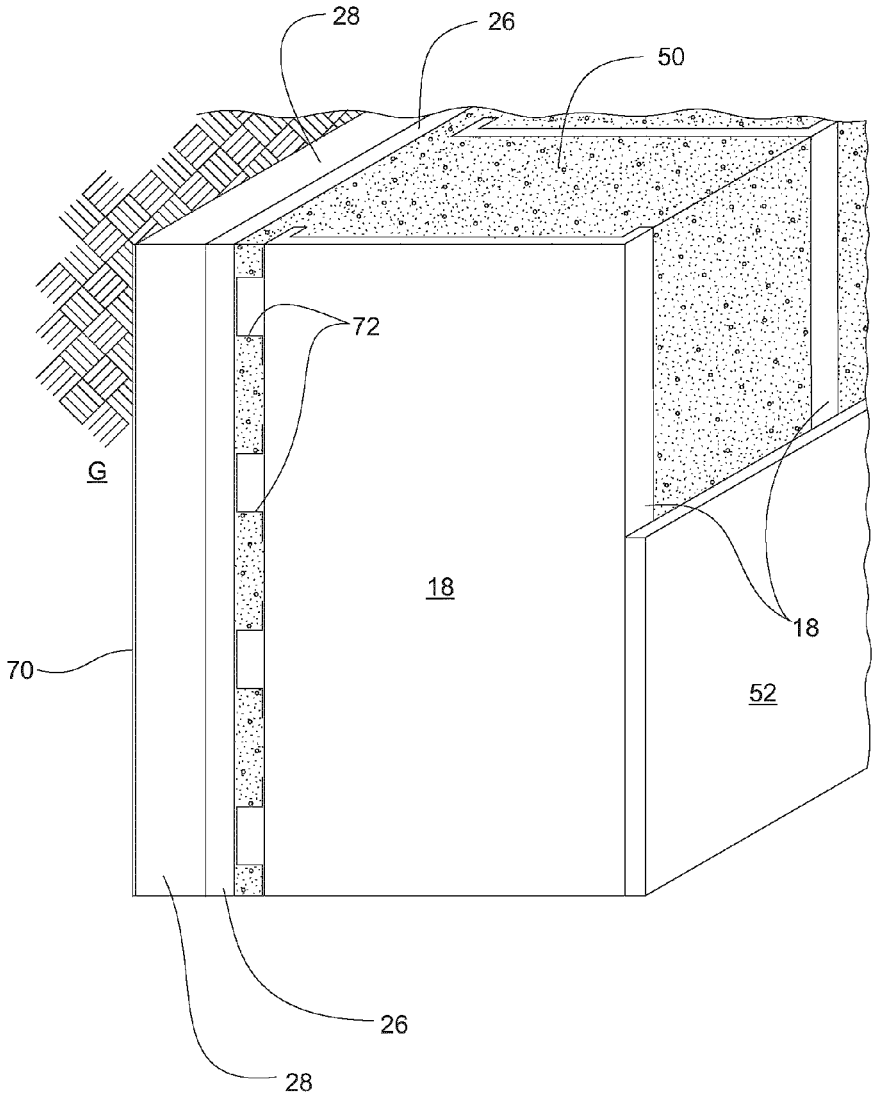
FIG. 7 is a perspective view of a portion of one of the wall panels subsequent to an installation.

With reference also to FIG. 7, when a lower portion of the multi-story panels extend below grade G, the exterior insulation layer 28 as well as the base layer 29 of finishing material can be applied to the exterior of the panel 12 continuously from the top end to the bottom end thereof; however, a suitable moisture resistant barrier or membrane 70 can also be applied to the lower portion of the exterior sheathing 26 of the panel 12 corresponding to the portion below grade G. The membrane 70 may be applied prior to erecting the wall panels. However, as there are vertical seams 32 between adjacent panels 12,12, one can also apply the membrane 70 after the panels are arranged, as a continuous sheet fully about the perimeter 16 of the wall panels.

As stated, the exterior sheathing materials 26 may be joined directly to the studs 18. Alternatively, the exterior sheathing material 26 may be joined to the studs 18 through a plurality of intermediate furring or elongate support members 72,72 . . . spanning perpendicularly across a plurality of the studs 18. Each support member 72 is arranged perpendicular to the studs 18,18 and span therebetween, each support member 72 being spaced vertically from each other support member. The support members 72 may comprise a suitable strapping or furring member, such as a 4" wide elongate metal channel member, the channel being from about ⅞" to about 2" deep.

Therefore, when the exterior sheathing material 26 is applied to an outer side of the support members 72, a substantially continuous gap 74 is formed along the inner side of the exterior sheathing layer, between the sheathing layer 26 and the studs 18. As shown in FIGS. 6 and 7, the continuous gap fills with concrete together with the spaces between the studs 18,18 to form a uniform concrete structure which encases the studs, further strengthening the structure of the wall panel 12.

Figure 9C:
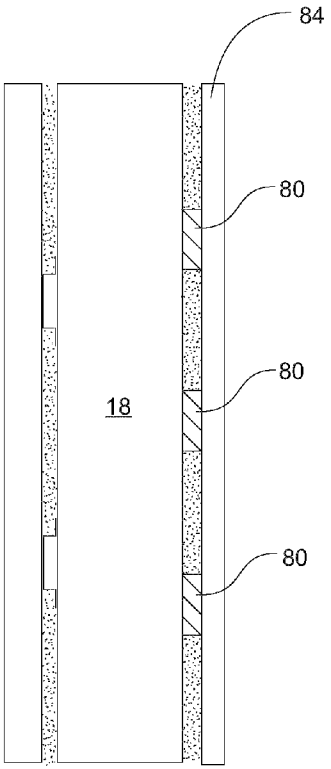
FIGS. 9A-9C are schematic illustrations of the steps involved in strengthening the walls panels using concrete and a form on the inside of the studs.
Figure 9B:
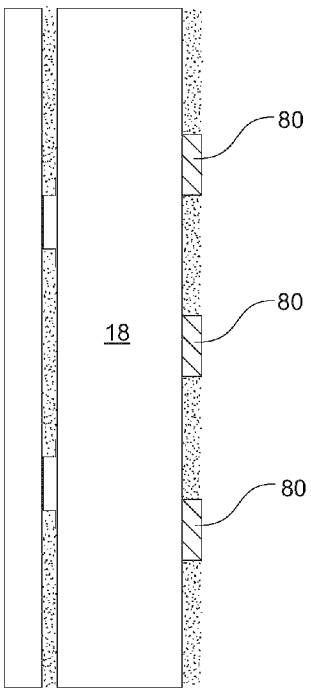
Figure 9A:
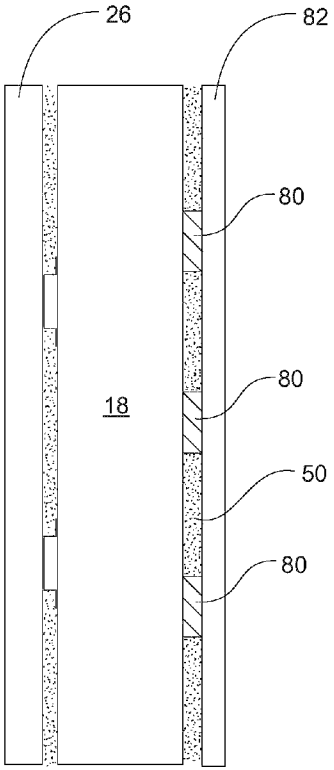

In one embodiment, with reference to FIGS. 9A-9C, —the interior side of the walls 12 can also be sheathed with a layer such as in embodiments where the walls 12 are to be filled with concrete. The studs 18 are provided with wooden strapping members or furring channels 80 on the interior side thereof for attaching a form 82 to the studs 18. The furring channels 80 extend perpendicular to the studs 82 on the interior side thereof, spaced apart vertically, prior to application of the form 82 so as to define a utility gap at the interior side of the panel 12 between the inner sides of the studs 18 and the form 82. The gap is then filled with concrete (FIG. 9A). After the gap is filled with concrete, the form 82 is removed (FIG. 9B). The inner side of the stud 18 is then sheathed with drywall 84 or another suitable interior finishing panel (FIG. 9C). Alternatively, the form 82 may be a rigid drywall which acts as both the form 82 for creating the gap and the interior finishing panel.

With reference to FIG. 8, one embodiment of a vertical seam 32 between adjacent panels is shown in which the base layer 29 including, supporting stucco wire or other form of mesh 31, is wrapped continuously across the exterior side of each panel 12 and both ends 29 of the adjacent panels 12. The ends 29 of each panel 12 are defined by the outermost studs which span the full height of the panel. To assist in weatherproofing of the perimeter, a gasket 33 is fit between the opposing, abutting ends 29,29 of the adjacent panels 12,12 between the respective base layers 29 of finishing material, further sealing the vertical seam 32. A suitable gasket 33 includes a flat strip of foam sealant material in the order of ⅛ of an inch in thickness. For improving the application of caulking, a suitable recessed or beveled corner edge 74 can be provided at the outermost surface along the vertical side edges of each wall panel 12 and meet at opposing, abutting ends 29,29. Typically the beveled corner edges 74,74 are located at the exterior side of the rigid insulation layer 28. When two panels are abutted at respective ends 29,29, the beveled corner edges 74,74 together form a recessed groove or channel 76 relative to the exterior surface for receiving a suitable caulking or joist filling compound.

In an optional embodiment, a batten or trim member 80 (dotted lines) can be provided to span and cover the vertical seam 32. The trim member 80 spans vertically along the exterior of the vertical seam 32. Alternatively, the recessed corners may receive a mating cap which follows the profile of the recessed groove including side flanges overlapping the exterior of the two adjacent panels relative to which they are sealed to function as an expansion joist between the adjacent panels. In yet further arrangements, no recessed corner may be provided on the panels so that a suitable mesh or tape strip overlaps the exterior side of the two adjacent panels across the vertical seam for being coated with the finishing layer together with the exterior sides of the panels after they are erected.

In further embodiments, the studs 18 may comprise wood studs. In this instance, the studs similarly span the full height of the multi-story wall panel between the header 20 and footer 22 as described above. In this instance, a layer of the exterior sheathing material 26 is similarly applied to the outer side of the studs 18 to form the panel 12 prior to erecting on the foundation 14. As in the previous embodiment, each perimeter wall panel 12 thus spans at least two stories S,S and can span the full height of all of the stories of the building 10 between the foundation 14 and a roof at the respective mounting location thereof. Floor joists 40 are attached to the wooden studs by respective ledgers 52 joined across or between respective wooden studs of the wall panels using typical joist hangers.

In further embodiments, the finishing layer 30 may comprise other finishing materials such as siding or various forms of building veneer. In this instance, a base layer 29 comprising a suitable material is again bonded to the exterior side of the insulation layer 28 to span across the panel 12 and is wrapped about the ends 29 of the panels prior to erecting the panels 12 with their ends 29 in abutment with one another. The vertical seams 32 can then be taped or sealed with caulking as described above prior to applying the finishing material 29,30 across the vertical seams.

In some applications, no concrete fill is required in the walls, even at the lower portion below grade. In this instance an inner side of the studs is typically lined with a suitable vapour barrier member prior to sheathing the inner side with drywall or another suitable interior finishing panel.

As the adjacent wall panels 12,12, and wall panels 12 to floor joists 18, are interconnected to each other using fasteners such as screws or bolts, the building structure can be easily mounted and dismounted, particularly before concrete is poured. Should the wall panels 12 be filled with concrete, the weight is significantly greater. Should both floors and wall panels be filled with concrete, some demolition is required at the concrete and reinforcing members extending therebetween. This renders the building structure reusable and the structure need not be discarded after a single use. The wall panels 12 and the floor joists may also be made of recyclable and environment friendly materials. The proposed building structure is rigid, economical, very easy to mount and dismount, stackable, reusable and recyclable, while allowing one to reduce costs associated with transportation and assembly of the structure.

Accordingly, a method of erecting a multi-story building 10 on a foundation 14 comprises forming a plurality of wall panels 12, each wall 12 panel comprising spaced apart vertical studs 18 and exterior sheathing material 26 spanning at least an exterior side 18*e* of the studs 18; erecting the wall panels 12 on the foundation 14 to form a perimeter of wall panels 12,12 . . . , at least some of the perimeter wall panels 12 being multi-story wall panels extending vertically to span two or more stories S,S of the building 10; joining adjacent wall panels 12,12; and joining a plurality of floor joists 40,40 . . . to the multi-story wall panels 12 to extend generally horizontally therefrom, the floor joists 40 being joined to the multi-story wall panels at an intermediate location between top and bottom ends 21,23 thereof. Adjacent wall panels can be secured to one another using fasteners.

Since various modifications can be made in my invention as herein above described, and many apparently widely different embodiments of same made within the scope of the claims without department from such scope, it is intended that all matter contained in the accompanying specification shall be interpreted as illustrative only and not in a limiting sense.

The embodiment of the inventor for which an exclusive property or privilege is claimed are defined as follows:

1. A method of erecting a multi-story building on a foundation, the method comprising:

forming a plurality of wall panels, each wall panel comprising spaced apart vertical studs and exterior sheathing material spanning at least an exterior side of the studs;

erecting the wall panels on the foundation to form a perimeter of wall panels, at least some of the perimeter wall panels being multi-story wall panels extending vertically to span two or more stories of the building;

joining a plurality of floor joists to the multi-story wall panels to extend generally horizontally therefrom, the floor joists being joined to the multi-story wall panels at an intermediate location between top and bottom ends thereof;

placing a barrier member in a channel space between adjacent joists, a top of the barrier member being recessed to define an upper recess between the top of the barrier member and a top plane of the joists; and filling at least the upper recess with concrete to encase the top of the adjacent joists for forming an upper floor surface of concrete.

2. The method of claim 1 wherein the joining of floor joists further comprising extending the joists generally horizontally between opposing multi-story panels of the one or more one multi-story panels.

3. The method of claim 1 further comprising, after joining the floor joists, applying interior sheathing material to an interior side of the wall panels.

4. The method of claim 1 wherein the forming of the plurality of wall panels further comprises:

applying an exterior rigid insulation layer over the exterior sheathing material; and applying a base layer of finishing material over the rigid insulation layer.

5. The method of claim 4 wherein after erecting the wall panels on the foundation, applying a final finishing layer to the base layer.

6. The method of claim 5 wherein prior to applying the final finishing layer, caulking vertical seams between adjacent wall panels at the exterior side of the panels.

7. The method of claim 1, wherein prior to joining a plurality of floor joists to the multi-story panels, further comprising forming a plurality of floor panels by incorporating the floor joists; and joining the floor joists of the floor panels to the studs of the multi-story wall panels.

8. The method of claim 1, further comprising filling spaces between the studs of the wall panels with concrete.

9. The method of claim 8 wherein the forming of the plurality of wall panels further comprises, between the studs and the exterior sheathing material, applying a plurality of spacer members arranged perpendicular to the studs and spanning therebetween, each spacer member spaced vertically from each other spacer member;

wherein the filling of the spaces between the studs at least partially encases the studs with concrete.

10. The method of claim 1, wherein at least a lower portion of at least some of the wall panels are below grade, further comprising:

filling spaces between the studs of at least the lower portion of said wall panels with concrete.

11. The method of claim 10 wherein at least a lower portion of at least some of the wall panels are below grade, further comprising:

installing a moisture resistant membrane on the exterior side of the lower portion of the exterior sheathing prior to erecting the panels.

12. The method of claim 1 wherein the forming of the upper floor surface of concrete further comprises filling spaces between the studs of the wall panels with concrete.

13. The method of claim 1 further comprising a barrier member of rigid insulation.

14. The method of claim 1 further comprising supporting each barrier member with ceiling sheathing spanning across a bottom of the joists.

15. The method of claim 1 wherein prior to joining the plurality of floor joists to the multi-story panels, further comprising:

forming a plurality of floor panels by incorporating the floor joists; and placing the barrier member in a channel space between adjacent joists of the floor panels for supporting the concrete of the upper floor surface, the top of the barrier member being recessed to define the upper recess between the top of the barrier member and the top plane of the joists, supporting the barrier members with ceiling sheathing spanning across a bottom of the joists; and joining the floor joists of the floor panels to the studs of the multi-story wall panels.

16. A method of erecting a multi-story building on a foundation, the method comprising:

forming a plurality of wall panels, each wall panel comprising spaced apart vertical studs and exterior sheathing material spanning at least an exterior side of the studs;

erecting the wall panels on the foundation to form a perimeter of wall panels, at least some of the perimeter wall panels being multi-story wall panels extending vertically to span two or more stories of the building;

extending a plurality of floor joists generally horizontally between opposed multi-story wall panels at an intermediate location between top and bottom ends of the opposed wall panels; and joining opposing ends of each floor joist of the plurality of floor joists directly to respective studs which are aligned with each other in the opposed wall panels, each opposing end overlapping a side of its respective stud, fasteners extending through the overlapping opposing end for joining to its respective stud for joining the joist thereto.

17. The method of claim 16 wherein the joining of floor joists comprising extending the joists generally horizontally between the respective studs of the opposed one or more one multi-story panels.

18. The method of claim 16 further comprising, after joining the floor joists, applying interior sheathing material to an interior side of the wall panels.

19. The method of claim 16 wherein the forming of the plurality of wall panels further comprises:

applying an exterior rigid insulation layer over the exterior sheathing material; and applying a base layer of finishing material over the rigid insulation layer.

20. The method of claim 19 wherein after erecting the wall panels on the foundation, applying a final finishing layer to the base layer.

21. The method of claim 20 wherein prior to applying the final finishing layer, caulking vertical seams between adjacent wall panels at the exterior side of the panels.

22. The method of claim 16, wherein prior to joining a plurality of floor joists to the multi-story panels, further comprising forming a plurality of floor panels by incorporating the floor joists; and joining the floor joists of the floor panels to the studs of the multi-story wall panels.

23. The method of claim 16, further comprising filling spaces between the studs of the wall panels with concrete.

24. The method of claim 23 wherein the forming of the plurality of wall panels further comprises, between the studs and the exterior sheathing material, applying a plurality of spacer members arranged perpendicular to the studs and spanning therebetween, each spacer member spaced vertically from each other spacer member;

wherein the filling of the spaces between the studs at least partially encases the studs with concrete.

25. The method of claim 16, wherein at least a lower portion of at least some of the wall panels are below grade, further comprising:

filling spaces between the studs of at least the lower portion of said wall panels with concrete.

26. The method of claim 25 wherein at least a lower portion of at least some of the wall panels are below grade, further comprising:

installing a moisture resistant membrane on the exterior side of the lower portion of the exterior sheathing prior to erecting the panels.

27. The method of claim 16, further comprising forming an upper floor surface of concrete spanning over the joists.

28. The method of claim 27 wherein the forming of an upper floor surface of concrete further comprises filling spaces between the studs of the wall panels with concrete.

29. The method of claim 27, wherein forming an upper floor surface of concrete spanning over the joists further comprises:

placing a barrier member in a channel space between adjacent joists for supporting the concrete of the upper floor surface, a top of the barrier member being recessed to define an upper recess between the top of the barrier member and a top plane of the joists, and filling at least the upper recesses with concrete to encase at least the top of the joists.

30. The method of claim 29 wherein the barrier member is rigid insulation.

31. The method of claim 27 wherein prior to joining a plurality of floor joists to the multi-story panels, further comprising:

forming a plurality of floor panels by incorporating the floor joists; and placing a barrier member in a channel space between adjacent joists for supporting the concrete of the upper floor surface, a top of the barrier member being recessed to define an upper space between the top of the barrier member and a top plane of the joists, supporting the barrier members with ceiling sheathing spanning across a bottom of the joists; and joining the floor joists of the floor panels to the studs of the multi-story wall panels.

32. The method of claim 16 further comprising supporting each barrier member with ceiling sheathing spanning across a bottom of the joists.

33. A method of erecting a multi-story building on a foundation, the method comprising:

forming a plurality of wall panels, each wall panel comprising spaced apart vertical studs and exterior sheathing material spanning at least an exterior side of the studs;

erecting the wall panels on the foundation to form a perimeter of wall panels, at least some of the perimeter wall panels being multi-story wall panels extending vertically to span two or more stories of the building;

forming a plurality of floor panels by incorporating a plurality of floor joists;

placing a barrier member in a channel space between adjacent joists, a top of the barrier member being recessed to define an upper space between the top of the barrier member and a top plane of the joists, forming an upper floor surface of concrete spanning over the joists, the barrier member supporting the concrete of the upper floor surface;

supporting the barrier members with ceiling sheathing spanning across a bottom of the joists; and joining the plurality of floor joists to the multi-story wall panels to extend generally horizontally therefrom, the floor joists being joined to the multi-story wall panels at an intermediate location between top and bottom ends thereof.

* * * * *